US006631723B1

(12) United States Patent
Mullin

(10) Patent No.: US 6,631,723 B1
(45) Date of Patent: Oct. 14, 2003

(54) ARTIFICIAL NAILS WITH THREE DIMENSIONAL FEATURES

(75) Inventor: Keith A. Mullin, LaJolla, CA (US)

(73) Assignee: Make Ideas, Inc., La Jolla, CA (US)

( * ) Notice: Subject to any disclaimer, the term of this patent is extended or adjusted under 35 U.S.C. 154(b) by 146 days.

(21) Appl. No.: 09/654,213

(22) Filed: Sep. 1, 2000

(51) Int. Cl.[7] ..... A45D 29/00

(52) U.S. Cl. ..... 132/73; 63/42; 401/7; 446/327

(58) Field of Search ..... 132/73, 73.5, 75, 132/75.3, 75.4, 75.6, 75.8, 76.2, 76.5, 285, 286, 200; 401/7, 8; 63/12, 42, 26; 446/327, 328; D28/56; D20/19, 22, 23, 24, 25, 34; D21/405, 406, 407, 411

(56) References Cited

U.S. PATENT DOCUMENTS

| | | | | | |
|---|---|---|---|---|---|
| 1,238,046 | A | * | 8/1917 | Nuss | 63/43 |
| 2,151,846 | A | * | 3/1939 | Greneker | 81/177.3 |
| 2,603,519 | A | * | 7/1952 | Sam | 294/25 |
| 2,864,384 | A | * | 12/1958 | Walter | 132/73 |
| 3,597,099 | A | * | 8/1971 | Tollin | 401/7 |
| 3,856,026 | A | * | 12/1974 | Gaydos | 132/73 |
| D238,357 | S | * | 1/1976 | Di Carlo | D19/36 |
| 4,107,947 | A | * | 8/1978 | Saito | 63/2 |
| 4,177,698 | A | * | 12/1979 | Greneker | 81/177.3 |
| D254,854 | S | * | 4/1980 | Texidor | D19/36 |
| 4,371,278 | A | * | 2/1983 | Joo | 401/195 |
| 4,498,314 | A | * | 2/1985 | Okamura | 63/2 |
| 4,581,088 | A | * | 4/1986 | House | 156/219 |
| D303,161 | S | * | 8/1989 | Tomkins | D28/56 |
| 4,876,121 | A | | 10/1989 | Cohen | |
| 4,898,192 | A | | 2/1990 | Cohen | |
| D308,584 | S | * | 6/1990 | Sells | D28/57 |
| 4,938,698 | A | * | 7/1990 | Chantry | 434/253 |
| 4,974,610 | A | | 12/1990 | Orsini | |
| 5,036,589 | A | * | 8/1991 | Heinrich | 30/298 |
| 5,622,587 | A | | 4/1997 | Barthelman | |
| 5,675,989 | A | * | 10/1997 | Abraskin | 63/41 |
| 5,724,999 | A | | 3/1998 | Kim | |
| D405,842 | S | * | 2/1999 | Palardis | D21/406 |
| D413,183 | S | * | 8/1999 | Drake | D28/56 |
| 5,975,087 | A | | 11/1999 | Jang | |
| D433,536 | S | * | 11/2000 | Schwartz | D28/56 |

* cited by examiner

*Primary Examiner*—Eduardo C. Robert
*Assistant Examiner*—David Comstock
(74) *Attorney, Agent, or Firm*—Blakely, Sokoloff, Taylor & Zafman LLP

(57) ABSTRACT

An artificial nail having a three dimensional feature. The three dimensional feature may be a three dimensional representation of any known or imagined person, place or thing. The three dimensional feature may have a protrusion that is graspable. The protrusion may be used to assist in placing the artificial nail onto a fingernail or toenail. The artificial nail may include a tool or writing implement that may be extendible/retractable, movable and/or rotatable. The artificial nail may include removably attached three dimensional features. The three dimensional feature may include hair. The three dimensional feature may include a sound emitter or be designed to emit sound. The three dimensional feature may be plush or made from fabric. The artificial nail may include a power source and a light emitter to emit light from a portion of the three dimensional feature.

24 Claims, 5 Drawing Sheets

ARTIFICIAL NAILS WITH THREE DIMENSIONAL FEATURES

BACKGROUND

1. Field of the Invention

The invention relates to artificial nails such as fingernails and toenails. More specifically, this invention relates to artificial nails with three dimensional features.

2. Background

Artificial nails are a well known and popular cosmetic item that are readily available for home use or professional application at salons, boutiques and drug stores. Artificial nails are commonly made of a plastic material such as acrylic. Artificial nails may be a solid color. Some artificial nails are first adhered to a nail and nail polish is then applied to the artificial nail.

To add a sense of style, fingernails and toenails, both natural and artificial may be embellished not just by nail polish, but by various other techniques. These techniques include painting designs or highlights on the fingernail, affixing decals and applying other applique to the fingernail, affixing or embedding faux gemstones on the fingernail, etc. Some techniques are quite involved. For example, U.S. Pat. No. 4,974,610 issued to Yuko Orsini entitled "Photographic Imprinting of Artificial Fingernails" teaches a method for making artificial fingernails in which a single photograph spans each of the nails in a set of ten nails, and U.S. Pat. No. 5,724,999 issued to Ho Choong Kim entitled "Method of Decorating A Finger Nail" teaches a method for extracting images obtained from a magazine and applying them to fingernails. Further examples include U.S. Pat. No. 4,581,088 issued to Robert E. House entitled "Finger Jewels" which teaches a method for making decorative imitation jewels and applying them with an adhesive to a fingernail. In addition, U.S. Pat. Nos. 4,876,121 and 4,898,192 issued to Allen L. Cohen entitled "Cosmetic Artificial Nails" and "Holographic False Nails," respectively, teach providing an illusion of length with artificial nails that include moiré patterns and holographic images.

BRIEF SUMMARY OF THE INVENTION

An artificial nail having a three dimensional feature. The three dimensional feature may be a three dimensional representation of any known or imagined person, place or thing. In one embodiment, the three dimensional feature may have a protrusion that is graspable. The protrusion may be used to assist in placing the artificial nail onto a fingernail or toenail. In one embodiment, the artificial nail may include a tool or writing implement that may be extendible/retractable, movable and/or rotatable. In another embodiment, the artificial nail may include removably attached three dimensional features. In yet another embodiment, the three dimensional feature may include hair. In another embodiment, the three dimensional feature may include a sound emitter or be designed to emit sound. In still another embodiment, the three dimensional feature may be plush or made from fabric. In a further embodiment, the artificial nail may include a power source and a light emitter to emit light from a portion of the three dimensional feature.

DETAILED DESCRIPTION

Artificial nails with three dimensional features that are pleasing to the wearer and to others are an exciting advancement in the world of artificial nails. In one embodiment, the artificial nails with three dimensional features include a protrusion that may be held between a person's thumb and fingers for ease of placement onto a person's nails. The three dimensional feature may be a three dimensional representation of any known or imagined person, place or thing. In various embodiments, the three-dimensional feature may be, for example, a facial reproduction, a head, a bust, a trademark, a logo, a famous point of interest. In various embodiments, a portion of the feature may protrude a sufficient distance from the top of the artificial nail and be of a size sufficient size for grasping between a person's thumb and fingers for ease of attaching the artificial nail to a fingernail or toenail. In various embodiments, the facial reproduction, the head, the bust, etc. may be of a person, a cartoon character, an animal or any other being, real, artistic or imaginative.

Figure 1:
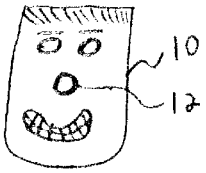
FIG. 1 is a top view of one embodiment of an artificial nail having a three dimensional facial representation of the present invention.

FIG. 1 is a top view of one embodiment of an artificial nail having a three dimensional facial representation of the present invention. In one embodiment, a three dimensional facial representation may be included on an artificial nail. Although the face of a human is depicted, the face may be of an animal, cartoon character, or any other being, real, artistic or imaginary. Although the face is depicted perpendicular to the edge of the base of the artificial nail, the face may be in any position such as diagonal, angled, etc in relation to the edge of the artificial nail.

In one embodiment, the three dimensional facial representation may be a layer upon a base nail that is similar to that of a traditional artificial nail. In another embodiment, the three dimensional facial representation and the base may be one combined piece. Artificial nail 10 may be made of any substance commonly used for making artificial nails such as plastics, acrylics, etc., including, for example, Acrylonitrile Butadiene Styrene, more commonly known as ABS plastic.

When the feature on the artificial nail is a facial representation, a portion of the face may extend a distance sufficiently great enough from the surrounding area of the artificial nail and be of a sufficient size so that the portion may be grasped between a person's thumb and fingers to apply the artificial nail to the person's fingernail or toenail. The size and dimensions of the protruding portion may vary based on the particular facial representation and based on which portion of the facial representation is intended for grasping. In one embodiment, nose 12 may extend a distance sufficiently great enough from the surrounding area of artificial nail 10 and may be of a sufficient size so that a person may grasp the nose for easy application of the artificial nail 10. In another embodiment, the hair or other portion of the face such as a mustache, beard, etc. may extend a distance sufficiently great enough from the surrounding area of the artificial nail and may be of a sufficient size so that a person may grasp it for easy application of the artificial nail.

In one embodiment, the facial representation may include multiple colors such that the facial representation imitates the coloring of the person, character, etc. from which the representation is derived. In another embodiment, the artificial nail may be a single uniform color. In this embodiment, the artificial nail may be painted with color according one's tastes. In this embodiment, any appropriate paint or nail polish may be used to color the artificial nail.

Figure 2:
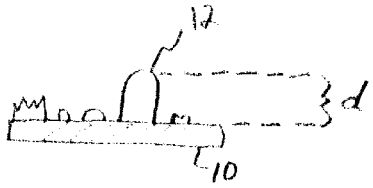
FIG. 2 is a side view of one embodiment of the present invention in which a three dimensional facial representation protrudes from an artificial nail.

FIG. 2 is a side view of one embodiment of the present invention in which a three dimensional facial representation protrudes from an artificial nail. This figure shows that a protruding portion of the three-dimensional feature such as nose 12 of a facial representation may extend a distance d from the surrounding area of artificial nail 10. In one embodiment, the distance d is large enough so that a typical adult may grasp the artificial nail. In another embodiment, the distance is large enough so that a typical child may grasp the artificial nail. In one embodiment, artificial nail 10 has the dimensions and contour of a typical nail. In this embodiment, the artificial nail is approximately as long as a typical nail such that it extends minimally beyond the end of a finger tip. In another embodiment, the artificial nail may be longer than a typical nail. That is, in this embodiment, the nail may extend beyond the wearer's finger tip and fingernail.

Figure 3:
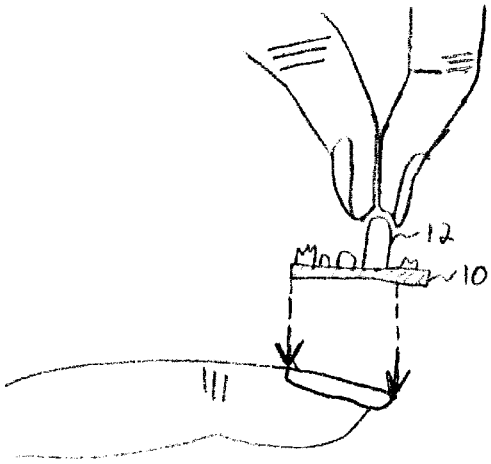
FIG. 3 is a view of a person grasping a protruding portion of a three dimensional feature according to one embodiment of the invention to apply an artificial nail to a fingernail.

FIG. 3 is a view of a person grasping a protruding portion of a three dimensional feature according to one embodiment of the invention to apply an artificial nail to a fingernail. In one embodiment, a person may grasp a protruding portion such as nose 12 of artificial nail 10 and apply it to a fingernail. In one embodiment, the artificial nail includes an adhesive on a surface of the artificial nail that is contoured to fit onto and is placed in contact with a fingernail or toenail for attachment. The adhesive may be any adhesive that allows for sufficient attachment to a fingernail or toenail, such as acrylic glue. In this embodiment, the adhesive may include a backing that must be removed before the artificial nail is applied to a fingernail or toenail. In this embodiment, the surface coated with an adhesive may be considered a bottom surface, and the surface that displays the three dimensional feature and is visible to the wearer and others may be considered the top surface. In another embodiment, the artificial nail is applied to a fingernail or toenail after the fingernail or toenail has been coated with an appropriate adhesive, such as acrylic glue.

Figure 4:
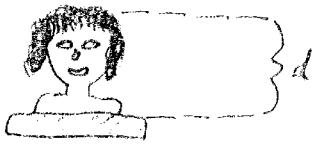
FIG. 4 is a front view of one embodiment of the present invention in which a three dimensional bust protrudes from an artificial nail.

FIG. 4 is a front view of one embodiment of the present invention in which a three dimensional bust protrudes from an artificial nail. Although the bust of a human is depicted, the bust may be of an animal, cartoon character, or any other being, real, artistic or imaginary. Although the bust is depicted sitting vertically on the base of the artificial nail, the bust may be in any position such as horizontal, diagonal, angled, etc in relation to the base of the artificial nail.

Figure 5:
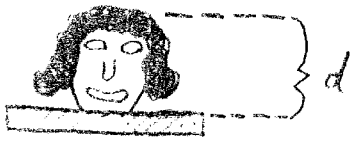
FIG. 5 is a front view of one embodiment of the present invention in which a three dimensional representation of a head protrudes from an artificial nail.

FIG. 5 is a front view of one embodiment of the present invention in which a three dimensional representation of a head protrudes from an artificial nail. Although the head of a human is depicted, the head may be of an animal, cartoon character, or any other being, real, artistic or imaginary. Although the head is depicted sitting vertically on the base of the artificial nail, the head may be in any position such as horizontal, diagonal, angled, etc. in relation to the base of the artificial nail.

Figure 6:
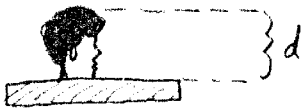
FIG. 6 is a side view of one embodiment of the present invention in which a three dimensional representation of a head protrudes from an artificial nail.

FIG. 6 is a side view of one embodiment of the present invention in which a three dimensional representation of a head protrudes from an artificial nail.

Figure 7:
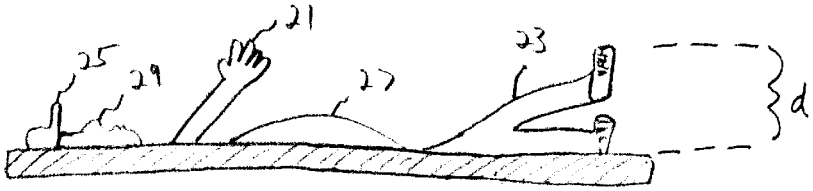
FIG. 7 is a side view of one embodiment of the present invention in which portions of a three dimensional person protrude from an artificial nail.

FIG. 7 is a side view of one embodiment of the present invention in which portions of a three dimensional representation of a person protrude from an artificial nail. In one embodiment, the three dimensional feature may be a representation of a person with portions of the person protruding from the artificial nail. In this embodiment, the portion or portions that protrude will vary depending on the person, animal, character, or other being, real, artistic or imaginary represented. In one embodiment, the protruding portion or portions may be any body part of a human, animal, animated character or imaginary person or creature. In one embodiment, a portion of the feature may extend a distance sufficiently great enough from the surrounding area of the artificial nail and be of a sufficient size so that the portion may be grasped between a person's thumb and fingers to apply the artificial nail to the person's fingernail or toenail. As depicted, leg 23, arm 21 or baseball hat 25 may all extend from the base of the artificial nail. In this embodiment, torso 27 and head 29 may also extend from the base. In one embodiment, arm 21 and/or leg 23 may extend a distance sufficiently great enough from the surrounding area of the artificial nail and be of a sufficient size so that the portion may be grasped between a person's thumb and fingers and used to hold the artificial nail to apply the artificial nail to the person's fingernail or toenail. In one embodiment, the representation may be of famous persons, characters or animals, such as, for example, sports figures (e.g., baseball players, football players and basketball players), cartoon characters, mascots, etc. In another embodiment, the three dimensional feature may be three dimensional logos, trademarks, or anything identified with any entity such as a business, family, school, union or other organization that may be represented in three dimension on the artificial nail. In one embodiment, a portion of the three dimensional feature may extend a distance sufficiently great enough from the surrounding area of the artificial nail and be of a sufficient size so that the portion may be grasped between a person's thumb and fingers to apply the artificial nail to the person's fingernail or toenail.

Figure 8:
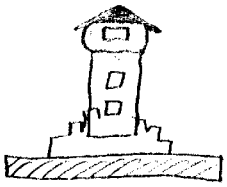
FIG. 8 is a side view of one embodiment of the present invention in which a three dimensional landmark such as a light house protrudes from an artificial nail.

FIG. 8 is a side view of one embodiment of the present invention in which a three dimensional representation of a landmark such as a light house protrudes from an artificial nail. In this embodiment, any well known landmarks such as mountains, buildings, historical monuments, etc. may be represented in three dimensions on the artificial nail. In one embodiment, a portion of the landmark may extend a distance sufficiently great enough from the surrounding area of the artificial nail and be of a sufficient size so that the portion may be grasped between a person's thumb and fingers to apply the artificial nail to the person's fingernail or toenail. In one embodiment, the three dimensional representation may include multiple colors such that the three dimensional representation imitates the coloring of the landmark, etc. from which the representation is derived. In another embodiment, the three dimensional representation may be a single uniform color. In this embodiment, the artificial nail may be painted with color according one's tastes. In this embodiment, any appropriate paint or nail polish may be used to color the artificial nail.

Figure 9:
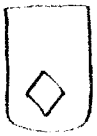
FIG. 9 is a top view of one embodiment of the present invention in which a three dimensional shape such as diamond protrudes from an artificial nail.
Figure 10:
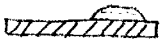
FIG. 10 is a side view of one embodiment of the present invention in which a three dimensional shape such as diamond protrudes from an artificial nail.

FIG. 9 is a top view of one embodiment of the present invention in which a three dimensional shape such as diamond protrudes from an artificial nail. FIG. 10 is a side view of one embodiment of the present invention in which a three dimensional shape such as diamond protrudes from an artificial nail. In this embodiment, any three dimensional shape such as squares, hearts, diamonds, stars, etc. may be represented in three dimensions on the artificial nail. In one embodiment, a portion of the three dimensional shape or the entire three dimensional shape may extend a distance sufficiently great enough from the surrounding area of the artificial nail and be of a sufficient size so that the portion or the entire three dimensional shape may be grasped between a person's thumb and fingers to apply the artificial nail to the person's fingernail or toenail. In one embodiment, the three dimensional representation may include multiple colors. In various embodiments, the three dimensional shape may be a single uniform color matching the color of the base portion of the nail, the three dimensional shape may be one color and the base portion of the nail may be another color, and the three dimensional shape and/or the base portion of the nail may be multiple colors. In one embodiment, the artificial nail may be painted with color according one's tastes. In this embodiment, any appropriate paint or nail polish may be used to color the artificial nail.

Figure 11:
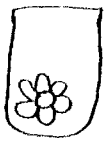
FIG. 11 is a top view of one embodiment of the present invention in which a three dimensional representation of a flower protrudes from an artificial nail.
Figure 12:
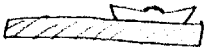
FIG. 12 is a side view of one embodiment of the present invention in which a three dimensional representation of a flower protrudes from an artificial nail.

FIG. 11 is a top view of one embodiment of the present invention in which a three dimensional representation of a flower protrudes from an artificial nail. FIG. 12 is a side view of one embodiment of the present invention in which a three dimensional representation of a flower protrudes from an artificial nail. In this embodiment, any flower or portion of a flower may be represented in three dimensions on the artificial nail. In one embodiment, a portion of the flower, such as, for example, a bud, or the entire three dimensional representation of the flower may extend a distance sufficiently great enough from the surrounding area of the artificial nail and be of a sufficient size so that the portion or the entire flower may be grasped between a person's thumb and fingers to apply the artificial nail to the person's fingernail or toenail. In one embodiment, the three dimensional representation of the flower may include multiple colors. In this embodiment, the multiple colors of the three dimensional representation may imitate the coloring of the flower from which the representation is derived. In various embodiments, the flower may be a single uniform color matching the color of the base portion of the nail, the flower may be one color and the base portion of the nail may be another color, and the flower and/or the base portion of the nail may be multiple colors. In one embodiment, the artificial nail may be painted with color according one's tastes. In this embodiment, any appropriate paint or nail polish may be used to color the artificial nail. Although only a flower is discussed in this embodiment, other naturally occurring botanical plants may be represented in whole or in part on the artificial nail.

Figure 13:
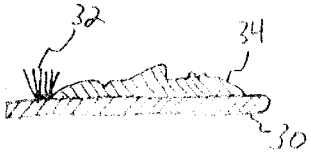
FIG. 13 is a side view of one embodiment of the present invention in which a three dimensional facial representation comprising hair and a plush material protrudes from an artificial nail.

FIG. 13 is a side view of one embodiment of the present invention in which a three dimensional facial representation comprising hair and a plush material protrudes from an artificial nail. In one embodiment, the three dimensional feature of an artificial nail 30 may include or be augmented by artificial hair 32 or fur. In another embodiment, the three dimensional feature may be a plush material such as cloth or fabric 34 and may be padded or quilted cloth or fabric that is attached to the base of the artificial nail. In this embodiment, the plush three dimensional feature may be enhanced by artificial hair or fur that is attached to the artificial nail and/or the plush three dimensional feature. In a related embodiment, the plush three dimensional feature may include miniature buttons, zippers, etc., and may be a representation of clothing worn by persons, and may be a miniature doll that represents a clothed person, character, animal, real or imagined.

Figure 14A:
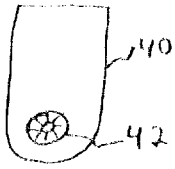
FIGS. 14A–C is a top view of one embodiment of the present invention in which an artificial nail includes a tool attached by a snap.
Figure 14B:
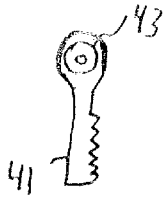
Figure 14C:
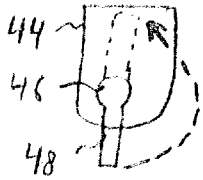

In one embodiment, the artificial nail may include a tool such as, for example, a screwdriver, file, hammer, saw, etc. In this embodiment, the tool may be removably attached, pivotably attached, extendibly attached and/or retractably attached. FIGS. 14A–C is a top view of one embodiment of the present invention in which an artificial nail includes an attached tool. In one embodiment in which the tool is removably attached, the artificial nail 40 includes a female portion of a snap 42 to which a tool such as saw 41 may be attached via the male portion of a snap 43, as shown in FIGS. 14A and 14B. In this embodiment, the male portion of the snap 43 is part of the tool, saw 41. In a related embodiment, a snap, a hook and loop fastener such as a VELCRO® fastening system, or any other suitable attaching means may be used to removably attach the tool to the artificial fingernail. In these embodiments, one half of the attaching means may be coupled to or part of the artificial nail, and the other, complementary, half of the attaching means may be coupled to or part of the tool. In this way, tools may be moved from one finger to the next, or may be traded with other persons wearing the artificial nail of the present invention. In another embodiment, the tool may be pivotably attached to the artificial nail. For example, screwdriver 48 may be pivotably attached to artificial nail 44 via connector 46. In one embodiment, connector 46 may be a snap that allows the hammer or other tool to rotate about an arc in a plane parallel to the plane of the surface of the artificial nail, such as a circle or semi-circle such that the tool may be moved on top of the artificial nail, as shown in FIG. 14C.

Figure 15A:
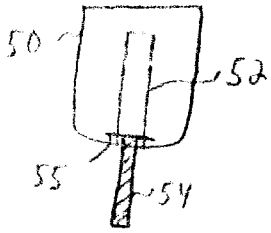
FIGS. 15A–C are top views of various embodiments of the present invention in which an artificial nail includes a writing implement.
Figure 15B:
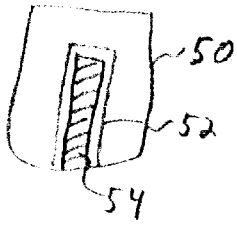
Figure 15C:
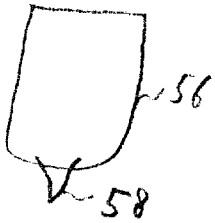

In one embodiment, the artificial nail may include an extendable/retractable tool such as a screw driver, file, writing implement, etc. FIGS. 15A–C are top views of various embodiments of the present invention in which an artificial nail includes a writing implement. In one embodiment, the extendable/retractable tool may include side rails that fit into side grooves in a slot made to receive the implement in the artificial nail. In this embodiment, writing implement 54, that is pen, pencil, etc., may extend from artificial nail 50 and may be pushed or slid back into the artificial nail and be stored in slot 52. In one embodiment, writing implement 54 may include end stop 55 which prevents the writing implement from being detached from artificial nail 50. In various embodiments, writing implement 54 may be any tool or writing implement that can be retractably attached to an artificial nail. When retracted into the artificial nail, the tool and nail may appear from the top, as shown in FIG. 15B. In a related embodiment, a quill 58 or other writing implement for placing into ink for drawing, writing, etc. may be included with artificial nail 56, as shown in FIG. 15C.

Figure 15D:
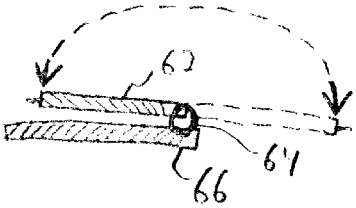
FIG. 15D is a side view an embodiment of the present invention in which an artificial nail includes a foldably attached writing implement.

FIG. 15D is a side view an embodiment of the present invention in which an artificial nail includes a foldably attached writing implement. In a related embodiment, a writing implement or tool may be foldably connected to an artificial nail. In this embodiment, one end of the tool or writing implement 62 may be connected by a hinge 64 or similar attaching means to artificial nail 66 such that the tool or writing implement may fold out from the artificial nail. In one embodiment, the hinge or other attaching means may be placed toward the finger tip end of the artificial nail so that the tool or writing implement is stored flush or parallel to the artificial nail when not extended. In one embodiment, the tool or writing implement 62 may sit on top of and parallel to the surface of the artificial nail 66 when not extended or folded out, as shown in FIG. 15D. In another embodiment, the tool or writing implement may be fit into a slot in the artificial nail so that when not extended or not folded out, the tool or writing implement is flush with and does not protrude from the artificial nail. In this embodiment, a means for grasping the tool or writing implement when folded into the artificial nail must be provided. In this embodiment, the means for grasping may be a protrusion from the writing implement or tool (not shown), or an intrusion in the artificial nail adjacent to the to or writing implement (not shown) that allows for accessing the tool or writing implement stored in the slot in the artificial nail.

Figure 16A:
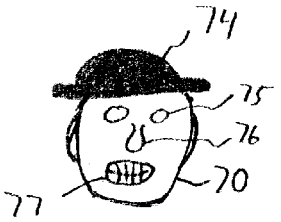
FIGS. 16A–C are top, bottom, and side views of one embodiment of the present invention in which an artificial nail includes a removable and interchangeable three dimensional feature.
Figure 16B:
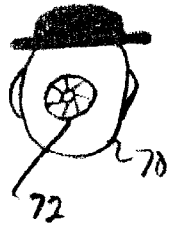
Figure 16C:
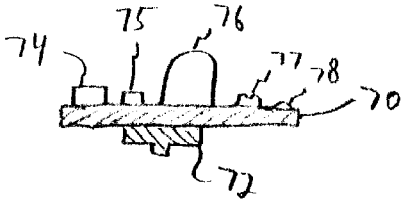

FIGS. 16A–C are top, bottom, and side views of one embodiment of the present invention in which an artificial nail includes a removable and interchangeable three dimensional feature. As discussed above regarding tools that may be removably attached to an artificial nail, in one embodiment, any three-dimensional representation of a person, place, or thing, real or imaginary, may be removably attached to an artificial nail. For example, a three dimensional feature may be, in one embodiment, a representation of a face 70 having three dimensional characteristics such as hat 74, eyes 75, nose 76, and mouth and lips 77, as shown in FIG. 16A. In this embodiment, the three dimensional feature in the form of a face, 70, includes the male portion of a snap 72 on a side opposite the side on which the face is provided. A side view shows the three dimensional characteristics such as hat 74, eye 75, nose 76, lips 77, and chin 78 of face 70 on the top side of the removable three dimensional feature, and male snap portion 72 on the bottom side of face 70. In this embodiment, the removable three dimensional feature may be removably attached to an artificial nail, such as artificial nail 40 that includes a female portion of a snap 42, as shown in FIG. 14A. In a related embodiment, a snap, a hook and loop fastener, or any other suitable attaching means may be used to removably attach the three dimensional feature to the artificial fingernail. In these embodiments, one half of the attaching means may be coupled to or part of the artificial nail, and the other, complementary half of the attaching means may be coupled to or part of the three dimensional feature. In this way the three dimensional feature may be moved from one finger to the next, or may be traded with other persons wearing an artificial nail of the present invention. In these embodiments, the three dimensional feature may be grasped between a person's thumb and finger by the edges of the three-dimensional feature, or a graspable protrusion extending from the three dimensional feature may be grasped between a person's thumb and finger to attach and to remove the three dimensional feature from an artificial nail.

Figure 17:
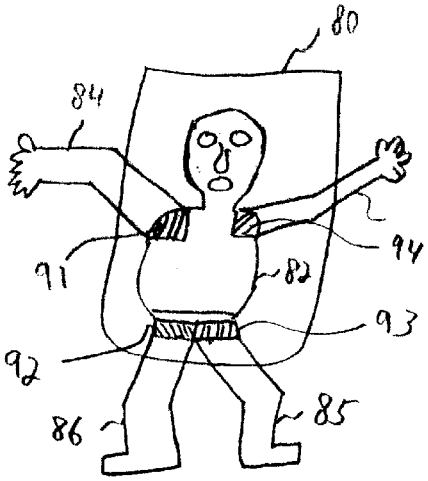
FIG. 17 is a top view of one embodiment of the present invention in which an artificial nail having a three dimensional feature includes a plurality of extending three dimensional portions.

FIG. 17 is a top view of one embodiment of the present invention in which an artificial nail having a three dimensional feature includes a plurality of extending three dimensional portions. In one embodiment, the three dimensional feature of an artificial nail may have a extending three dimensional portion or portions. In one embodiment, these three dimensional portions may also be movable. In one embodiment, if a body of a person or character 82 is represented on an artificial nail 80, arms 83 and 84, and legs 85 and 86 may extend from the artificial nail, as depicted in FIG. 17. In one embodiment, the extending portions may be pivotably or movably attached to the artificial nail such as by connectors 91, 92, 93 and 94. Connectors 91, 92, 93 and 94 may be a hinge assembly, ball joint assembly or other suitable connecting means. In one embodiment, the entire artificial nail is made of one substance such that the extending portions are not attached to, but are part of the artificial nail. In another embodiment, the extending portions may include bendable connections such as joints in the legs and arms. These bendable connections may be a hinge assembly, ball joint assembly or other suitable bending means. Although a body of a person or character is depicted in FIG. 17, in various embodiments, two dimensional or three dimensional representations of buildings, landmarks, animals, symbols, geometric shapes, company logos, and any person, place or thing, real or imagined, or any portion thereof, that is part of an artificial nail may include extending portions or movable extending portions.

Figure 18A:
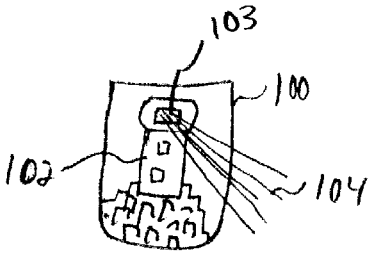
FIGS. 18A and 18B are top and side views of one embodiment of the present invention in which an artificial nail includes a light emitter coupled to a power source to emit light from a portion of a three dimensional feature in the artificial nail in the form of a light house.
Figure 18B:
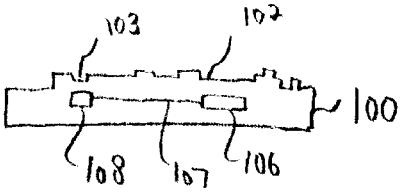

FIGS. 18A and 18B are top and side views of one embodiment of the present invention in which an artificial nail includes a light emitter coupled to a power source to emit light from a portion of a three dimensional feature in the artificial nail in the form of a light house. In one embodiment, a three dimensional feature of an artificial nail may include a light emitter through which light is emitted. In this embodiment, the artificial nail may include a battery coupled to the light emitter. For example, artificial nail 100 may include a three dimensional feature in the form of a lighthouse 102 that includes a light emitter 108 to emit light 104, as shown in FIG. 18A. In one embodiment, a power source 106, such as a battery, may be coupled by a wire or other connector 107 to light emitter 108 such that light is emitted through the light portion 103 of lighthouse 102 of artificial nail 100, as shown in FIG. 18B. Light emitter 108 may be a bulb, light emitting diode (LED), liquid crystal display (LCD) or other suitable light emitting or displaying device. In one embodiment, light is emitted when the three dimensional feature of the artificial nail is pressed by for example, another of a wearer's fingers such that a connection between the power source and the light emitter is established and/or the power source is activated.

Figure 19A:
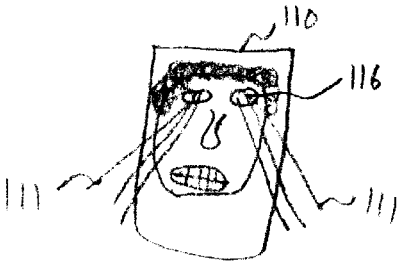
FIGS. 19A and B are top and side views of one embodiment of the present invention in which an artificial nail includes a light emitter coupled to a power source includes to emit light from two portions of a three dimensional feature in the artificial nail in the form of a human face.

FIGS. 19A and B are top and side views of one embodiment of the present invention in which an artificial nail includes a light emitter coupled to a power source includes to emit light from two portions of a three dimensional feature in the artificial nail in the form of a human face. In one embodiment, artificial nail 110 may include a three dimensional face that may emit light 111 from eyes 116, as shown in FIG. 119A. In this embodiment, artificial nail 110 may include battery 112 coupled via wire or other connector to light emitter 114, as shown in FIG. 119B. Further, artificial nail 10 may emit light from eye 116 when nose 118 is pressed to close a connection or switch on power source 112 and/or light emitter 114.

Figure 19B:
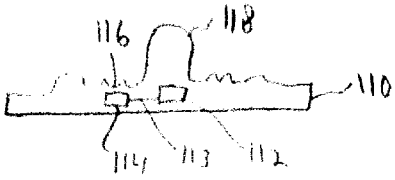

Although only a lighthouse and a face are depicted in FIGS. 18 and 19, in 30 various embodiments, any three dimensional representations of buildings, landmarks, animals, symbols, geometric shapes, company logos, and any person, place or thing, real or imagined, or any portion thereof, included as part of an artificial nail may include a light emitter and power source.

Figure 20A:
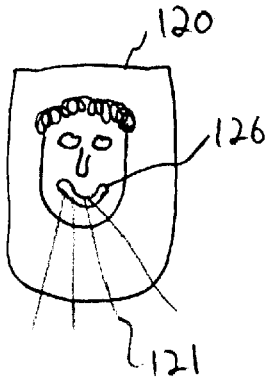
FIGS. 20A and 20B are top and side views of one embodiment of the present invention in which an artificial nail includes a sound emitter coupled to a power source included to emit sound from a three dimensional feature in the artificial nail in the form of a human face.
Figure 20B:
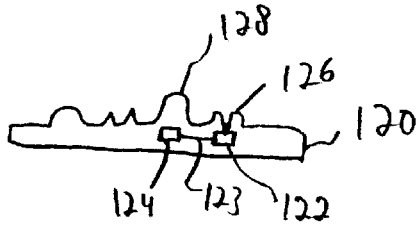

In addition, in one embodiment, the light emitter discussed above may be substituted by and/or paired with a sound emitter. FIGS. 20A and B are top and side views of one embodiment of the present invention in which an artificial nail includes a sound emitter coupled to a power source included to emit sound from a three dimensional feature in the artificial nail in the form of a human face. In this embodiment, whenever a wearer of the artificial nail presses on a portion of the artificial nail, a sound may be produced by the sound emitter. In one embodiment, sound is emitted when the three dimensional feature of the artificial nail is pressed by for example, another of a wearer's fingers such that a connection between the power source and the sound emitter is established and/or the power source is activated. In one embodiment, artificial nail 120 may include a three dimensional face that may emit sound from mouth 126, as shown in FIG. 20A. In this embodiment, artificial nail 120 may include battery 124 coupled via wire 123 or other connector to sound emitter 122, as shown in FIG. 20B. Further, artificial nail 120 may emit sound 121 from mouth 126 when nose 128 is pressed to close a connection or switch on power source 124 and/or sound emitter 122.

Figure 21A:
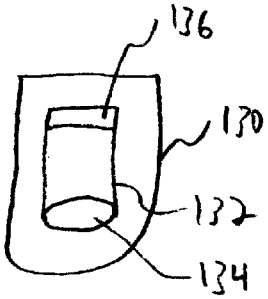
FIGS. 21A and 21B are top and side views of one embodiment of the present invention in which an artificial nail includes a sound emitter in the form of whistle.
Figure 21B:
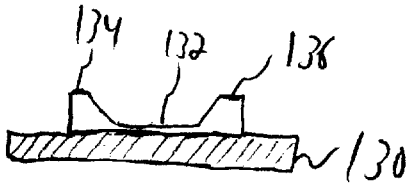

In yet another embodiment, an artificial nail may include a three dimensional feature that allows the wearer of the nail to produce sounds. In one embodiment, the artificial nail may include a three dimensional feature that is constructed so that when a user blows air on or through the three dimensional feature, a sound is produced. In this way, the three dimensional feature may serve as a whistle or behave as an harmonica. In this embodiment, each of a plurality of three dimensional features may be applied to a set of artificial nails that are applied to the nails on fingers of a user's hand so that when the wearer blows through two or more of the three dimensional features, a chordlike sound that may be similar to the sound produced by an harmonica or a train whistle may be emitted. In this embodiment, the three dimensional feature may be of one piece with the base of the artificial nail. FIGS. 21A and 21B are top and side views of one embodiment of the present invention in which an artificial nail includes a sound emitter in the form of whistle. Artificial nail 130 may have a integrally molded whistle 132, in which a receiving end 134 receives air from a wearers mouth and emits sound from exit portion 136. In a related embodiment, the three dimensional feature may be augmented by an attached metal or plastic portion that in conjunction with the base of the artificial nail allows for sounds to be created when a user blows through the three dimensional feature of the artificial nail.

Figure 22A:
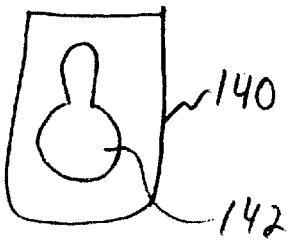
FIGS. 22A and 22B are top and side views of one embodiment of the present invention in which an artificial nail includes a sound emitter in the form of a cavity and particles therein.
Figure 22B:
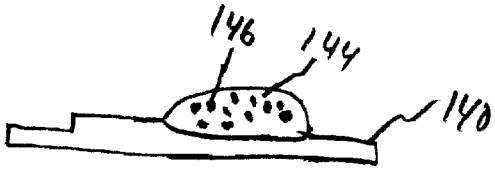

In still another embodiment, the three dimensional feature may provide for the production of sounds such as by shaking similar to a maraca, rattle, or similar device. FIGS. 22A and 22B are top and side views of one embodiment of the present invention in which an artificial nail includes a sound producer in the form of a cavity and particles therein. In this embodiment, artificial nail 140 may have a three dimensional feature such as, for example, a maraca 142 that may include a cavity 144 that is inhabited by small pieces or particles 146 of metal, plastic or other suitable substance so that when the hand or finger to which the artificial nail is attached is moved, the finger emits a sound. This is achieved by the small pieces colliding with each other and/or the wall of the cavity. In various embodiments, the small pieces may be hollow or solid particles of a generally round, egg or oval shape, or of an irregular shape. In a related embodiment, the pieces may be made of materials complementary to one another or the wall of the cavity such that the sound made during collision with the cavity wall or with each other is enhanced to increase the volume or timbre resulting from the collision. In this vein, in another embodiment, the wall of the cavity may be lined with a material complementary to the material of which the particles are made.

Although the above discussion has explicitly mentioned artificial nails, it should be understood that the invention is equally applicable to human fingernails and toenails, and may also be applied, in larger form, to animals such as the hooves of cattle to horses, or any unguis of any animal, large or small.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An artificial nail comprising:

a top surface and a bottom surface, said top surface having a raised three dimensional feature, said raised three dimensional feature, said top surface and said bottom surface form one solid component, wherein said bottom surface is adapted to be removably attached to a nail, wherein said artificial nail is molded with the three-dimensional feature being included in the molded form.

2. The artifical nail of claim 1 wherein the three dimensional feature is a facial representation of at least one of a complete and a portion of one of a person, an animal, an imaginary creature and an animated character.

3. The artificial nail of claim 1 wherein the three dimensional feature is one of a representation of an identifying mark of an organization, a landmark, and a flower.

4. The artificial nail of claim 1 wherein the three dimensional feature comprises a moveable portion and a non-moveable portion, said moveable, portion movable in relation to a base of the artificial nail.

5. The artificial nail of claim 4 wherein the moveable portion comprises at least one of a head, a bust, a tail, an arm, a leg, a hat, a body, a body part, a building, a flower, a three dimensional shape that moves in relation to the base of the artificial nail and other portions of the three dimensional feature.

6. The artificial nail of claim 1 further comprising:

a power source; and a light emitter, wherein the light emitter emits light through a through hole in the three dimensional feature.

7. The artificial nail of claim 1 wherein the three dimensional feature includes at least one of a plurality of artificial hair and a plurality of artificial fur.

8. The artificial nail of claim 1 wherein the three dimensional feature is a whistle.

9. The artificial nail of claim 1, said three dimensional feature having a graspable portion.

10. The artificial nail of claim 9 wherein the graspable portion comprises at least one of a head, a bust, a tail, an arm, a leg, a hat, a body, a body part, a building, a flower, and a geographical landmnark.

11. The artificial nail of claim 1 wherein the nail is at least one of a human fingernail and a human toenail.

12. The artificial nail of claim 1 wherein the nail is the unguis of any animal.

13. An artificial nail comprising:

a top surface and a bottom surface, and a first snap connector formed in said top surface, said first snap connector removably coupled to a bottom portion of a raised three dimensional object having a second snap connector as part thereof, said first snap connector and said second snap connector being complimentary to each other, said top surface and said bottom surface form one solid component, wherein said bottom surface is adapted to be removably attached to a fingernail, wherein said first snap connector is molded with said artificial nail.

14. The artificial nail of claim 13 wherein the three dimensional feature is a facial representation of at least one of a complete and a portion of one of a person, an animal, an imaginary creature and an animated character.

15. The artificial nail of claim 13 wherein the three dimensional feature is one of a representation of an identifying mark of an organization, a landmark, a flower.

16. The artificial nail of claim 13 wherein the three dimensional feature is a whistle.

17. The artificial nail of claim 13 wherein the nail is at least one of a human fingernail and a human toenail.

18. The artificial a of claim 13 wherein the nail is the unguis of any animal.

19. An artificial nail comprising:

a top surface and a bottom surface, and a track portion coupled to said top surface, said track portion slidably coupled with a non-removable extendable/retractable object, said extendable/retractable object sidable on said track portion, said top surface and said bottom surface form one solid component, wherein said bottom surface is adapted to removably attached to a fingernail, and said extendable/retractable object completely fits within said track portion when retracted.

20. The artificial nail of claim 19, wherein the extendable/retractable portion comprises one of a writing implement, a screwdriver, and a file.

21. An artificial nail comprising:

a top surface and a bottom surface, said top surface and said bottom surface form one solid component, and a three dimensional object rotatably coupled to said top surface, wherein said three dimensional object to rotate horizontally to said top surface, and said artificial nail is molded with the three-dimensional feature being included in the molded form.

22. The artificial nail of claim 21 wherein the artificial nail adapted to attach the to at least one of a human fingernail and a human toenail.

23. An artificial nail comprising:

a top surface and a bottom surface, said top surface having a raised three dimensional feature, said raised three dimensional feature, said top surface and said bottom surface form one solid component, said bottom surface is adapted to be removably attached to a nail, a power source, and a light emitter, the light emitter emits light through a through hole in the three dimentional feature.

24. The artificial nail of claim 23 wherein the nail is at least one of a human fingernail and a human toenail.

* * * * *